United States Patent [19]

Economy et al.

[11] 3,967,925

[45] July 6, 1976

[54] CATIONIC DYEING OF NOVOLOID FIBERS

[75] Inventors: James Economy, Eggertsville; George Y. Lei, Williamsville, both of N.Y.

[73] Assignee: The Carborundum Company, Niagara Falls, N.Y:

[22] Filed: Sept. 19, 1974

[21] Appl. No.: 507,658

[52] U.S. Cl. ..... 8/173; 8/92; 8/93

[51] Int. Cl.[2] ..... D06P 5/04

[58] Field of Search ..... 8/93, 168, 4, 92, 162, 8/173

[56] References Cited

UNITED STATES PATENTS

| | | | |
|---|---|---|---|
| 2,524,811 | 10/1950 | Koberlein | 8/4 |
| 3,651,199 | 3/1972 | Blume | 264/236 |
| 3,674,420 | 7/1972 | Sapers | 8/173 |
| 3,716,521 | 2/1973 | Economy et al. | 264/176 F |
| 3,808,289 | 4/1974 | Okuhashi et al. | 161/172 X |
| 3,848,044 | 11/1974 | Hagiwara et al. | 264/176 F |

FOREIGN PATENTS OR APPLICATIONS

| | | | |
|---|---|---|---|
| 2,318,762 | 10/1973 | Germany | 8/162 R |
| 2,319,491 | 10/1973 | Germany | 8/162 R |
| 609,947 | 10/1948 | United Kingdom | 8/55 L |
| 856,381 | 12/1960 | United Kingdom | 8/54 |

OTHER PUBLICATIONS

Chemical Abstracts; vol. 80; 1974; Ref. No. 1222905.

*Primary Examiner*—Lewis T. Jacobs
*Attorney, Agent, or Firm*—David E. Dougherty; Raymond W. Green

[57] ABSTRACT

Compositions are disclosed for dyeing cross-linked novolac fibers, and blends thereof with aromatic polyamides, using cationic dyes.

14 Claims, No Drawings

CATIONIC DYEING OF NOVOLOID FIBERS

BACKGROUND OF THE INVENTION

The present invention relates to cationic dyeing of cross-linked phenolic resin fibers and blends thereof with aromatic polyamides.

Novoloids, infusible cured phenolic resins containing at least 85 percent cross-linked novolac, may be produced by fiberization of a novolac melt and subsequent cross-linking or curing to an infusible stage. Curing may be effected in the presence of a source of methylene groups, such as paraformaldehyde, formaldehyde, or hexamethylenetetramine, and preferably also in the presence of an acidic or basic catalyst. Such novoloid fibers are disclosed in the following U.S. Patents, which are incorporated herein by reference: U.S. Pat. No. 3,650,102, issued Mar. 21, 1972, to Economy et al; U.S. Pat. No. 3,716,521, issued Feb. 13, 1973, to Economy et al; and U.S. Pat. No. 3,723,588, issued Mar. 27, 1973, to Economy et al. Novoloid fibers may be formed into felts, mats, cloths, rovings, or other useful embodiments in accordance with conventional fiber handling techniques. A fabric of such fibers is disclosed by U.S. Pat. No. 3,628,995, issued Dec. 21, 1971, to Economy et al.

Novoloid fibers have a number of highly desirable attributes which render them of value in numerous applications. Their most outstanding virtue is excellent flame resistance. When subjected to flame, the infusible fibers do not melt, but rather char to produce carbon fibers, which continue to retain the shape and approximate dimensions of the original fibers, and which continue to afford extremely effective protection from flames. Accordingly, the fibers are of great utility in the fabrication of flame-protective clothing, as well as drapes, carpeting, upholstery, and the like which are especially suited for use in areas where fire constitutes a particular hazard. Such fibers also provide very effective thermal and accoustical insulation, and again are particularly useful for these applications where fire is a hazard. The fibers have suitable mechanical properties, such as tenacity and break elongation, to permit their being processed into yarns, woven and knitted fabrics and the like, as well as various non-woven forms such as felt, batting, and paper.

Notwithstanding such desirable attributes, infusible cured phenolic resin fibers have several disadvantages. Just after curing, they are generally quite intensely colored, the hue ranging from very pale yellow to gold. Moreover, upon standing, the coloration may increase considerably in intensity, becoming deep brown or reddish brown. Thus, the fibers are known to possess rather poor color fastness.

Such novoloid fibers are particularly resistant to normal commercial dyeing processes. Accordingly, it has been difficult to obtain fibers and/or fabrics of the desired range of colors and color fastness. This detriment has a marked effect upon their acceptance by the textile industry and by the consumer with respect to applications for such fibers and fabrics in which color is an important factor.

In an attempt to overcome the deep coloration of such fibers, esterification or etherification of the phenolic hydroxyl groups may be utilized. In accordance with U.S. Pat. No. 3,716,521, of Economy et al, infusible cured phenolic resin fibers may be reacted with any of a wide variety of suitable esterification or etherification reagents, at a suitable temperature, for sufficient time to block at least about 50 percent, and preferably about 90 percent, of the phenolic hydroxyl groups of the cured resin. The blocking of phenolic hydroxyl groups may be accomplished after the resin has been cured to the point of infusibility, notwithstanding the cross-linked nature of the resin. Such fibers, while generally white in color and quite colorfast, have also, in the past, been difficult to dye to desired shades using commercially acceptable dyeing processes.

Cationic, or basic, dyes have been successfully utilized for dyeing such acrylic fibers as Orlon (E. I. duPont de Nemours and Company), Creslan (American Cyanamid Company), Acrilan (The Chemstrand Corporation), and polyester fibers such as basic dyeable Dacron (E. I. duPont de Nemours and Company). The basic nature of this family of dyes is due to one or more amino or imino groups. Typical chemical structures found in cationic dyes include azines, thiazines, xanthenes, diarylketonimines, triarylmethanes, and polymethines. While cationic dyes exhibit generally good fastness to light and washing when dyed on acrylic fibers, they have not been successfully used for dyeing phenolic fibers, and novoloid fibers in particular, prior to the present invention.

Summary of the Invention

In accordance with the present invention, infusible cured phenolic resin fibers, and blends thereof with aromatic polyamides, may be subjected to commercial scale cationic dyeing processes. The invention preferably comprises a dyeing formulation comprising from about five to about 7.5 percent cationic dye (based on fiber weight), at least about 6 percent benzyl alcohol or five percent benzyl alcohol/acetophenone dye carrier, one percent formic acid, one percent acetic acid, and 2.5 percent sodium nitrate electrolyte. The use of the proper proportions of formic acid and dye carrier are considered critical for promoting dye exhaustion.

Description of Preferred Embodiments

Exemplary of infusible phenolic resins considered suitable for dyeing in accordance with the present invention are those set forth by U.S. Pat. No. 3,650,102, of Economy et al. Cross-linked novolac fibers of this nature have been granted the designation "Novoloid" by the U.S. Federal Trade Commission, and are available from the Carborundum Company of Niagara Falls, New York, under the Trademark KYNOL™. Such fibers are produced by the formation of a melt of a fusible novolac which is capable of cross-linking in the presence of a suitable aldehyde, fiberization of said melt to form thermoplastic fusible fibers, and cross-linking thereof by heating in the presence of methylene groups to render them infusible.

Other suitable fibers include the aforementioned esterified or etherified resin fibers as prepared in accordance with U.S. Pat. No. 3,716,521, of Economy et al.

In addition, blends of these two infusible phenolic resin fibers may be dyed with cationic dyes in accordance with the present invention, as well as blends of an infusible phenolic resin fiber with aromatic polyamide fibers. Suitable aromatic polyamides include various fibers previously designated as nylon, a preferred example being Nomex aramid, an aromatic polyamide available from E. I. duPont de Nemours and Company. Blends of novoloid with up to 75 weight percent polyamide may be successfully subjected to cationic dyeing in accordance with the present invention.

The cationic dyeing process of the present invention utilizes a dye carrier or carriers, organic acids, and an electrolyte. As the dye carrier, benzyl alcohol or a benzyl alcohol/acetophenone (80/20) blend are suitable. When dyeing 100 percent novoloid, or blends of novoloid/polyamide, at least three percent carrier, by volume, is desirable, with a range of from about three percent to about ten percent carrier being suitable. In addition, carrying agents such as Chemocarrier FPN, available from Tenatex Company, are suitable in similar proportions.

The use of at least about 1 percent by volume, based on the dyeing bath, of formic acid has been found essential to the present invention. The formic acid may be present in a proportion of from about one percent to about ten percent or higher, and is most conveniently added to the dye bath in the form of concentrated acid (i.e., 90 percent concentration or higher). However, concentrations greater than about 5 percent are not economically advantageous. In addition, about one percent to about five percent acetic acid by volume is employed in the dye bath to promote dye exhaustion. This is conveniently added as a 56 percent solution with the formic acid.

As an electrolyte, sodium nitrate, sodium chloride, or sodium phosphate are suitable. A 2.5 percent by weight concentration of sodium nitrate is preferred, with from about 1.5 percent to about 3.0 percent being suitable.

In addition, the use of a small amount, i.e., less than 0.1 percent by weight, of a surface active agent is advantageous as a wetting agent. Various organic derivatives such as sodium salts of high molecular weight alkyl sulfates or sulfonates may be used, with about .04 percent by weight of Merpol SE surface active agent, available from E. I. duPont de Nemours and Company, being a preferred example.

From about one to about ten percent, or higher, and preferably from five to 7.5 percent of the selected cationic dye, based on weight of the fiber, is utilized. Various cationic or basic dyes may be used in the composition of this invention. Exemplary suitable cationic dyes include Genacryl yellow, red, blue, and orange, available from General Aniline and Film Company; Basacryl red, available from Badische Anilin and Soda Fabrik AG; and others. The selected dye is dissolved in distilled, soft, or deionized water to avoid formation of precipitates with magnesium, calcium, or other elements normally found in water.

Light stabilizers may also be utilized to enhance lightfastness. Exemplary of such compositions are substituted hydroxyphenyl benzotriazole ultraviolet absorbers, such as Tinuvin P, available from Ciba Geigy, or Rylex H, a hydroquinone ultraviolet absorber, available from E. I. duPont de Nemours and Company. These may optionally be used in concentrations of from 0.1 to ten percent by weight of the fiber.

While for purposes of experimental laboratory scale dyeing the fiber or fabric may be added to the completely mixed dye bath, it will be understood that in commercial dyeing equipment, different procedural steps may be followed. Thus, the dye bath ingredients may be added to the fiber in the dyeing equipment, for example.

The invention is further illustrated by the following Examples, although it is to be understood that the Examples are intended for purposes of illustration only and are not intended to limit the scope of the invention.

EXAMPLE 1

A fiber sample comprising KYNOL$^{tm}$ fibers, a novoloid fiber available from The Carborundum Company, is subjected to scouring to remove all traces of sizing, lubricants, or soil accumulation. Scouring is carried out with a surface active agent such as a soap or synthetic detergent. The undyed fiber is gold in color.

Merpol HCS surface active agent and tetrasodium pyrophosphate are added to distilled water at 27°C to form a one percent solution of each, by weight of the bath. The fiber is added to the scouring bath, and the temperature raised to 88°C at a rate of 1.5°C per minute, and run at that temperature for 20 minutes. The bath is then cooled to 38°C, and the fiber is removed and thoroughly rinsed with warm water.

The dye bath is made up using 7.5 percent Genacryl blue 3G cationic dye, based on fiber weight, with the bath ratio set at 30 cc./gram of fiber. The dye is added, with 0.4 grams/liter Merpol SE surface active agent, at 50°C while stirring. Sodium nitrate is added at a concentration of 25 grams/liter. Then, 50 grams/liter of benzyl alcohol/acetophenone (80/20) are added, and the bath is run for three minutes to achieve a uniform solution. Ten ml/liter each of formic acid (90 percent) and acetic acid (56 percent) are added, the fiber is placed in the bath, and the bath temperature is raised to 127°C at a rate of 1.6°C/minute. The bath is run for 1.5 hours at 127°C, cooled to 50°C, and dropped. The fiber is then rinsed with warm water (50° to 60°C).

The dyed fibers are after-scoured to remove the carrier and other organic ingredients from the finished product by washing in a bath comprising one percent Merpol HCS and 0.5 percent acetic acid. The bath is set at 50°C, raised to 82°C at a rate of 1.5°C per minute, and run for 15 minutes. The fibers are then rinsed in 50° to 60° water and dried. The resulting fibers are bright blue, uniformly colored, and exhibit only slight fade after 20 hours under a xenon arc light.

EXAMPLE 2

A sample of an esterified novoloid fiber prepared in accordance with U.S. Pat. No. 3,716,521, is subjected to dyeing in accordance with the procedure and composition set forth in Example 1. The resultant dyed fiber is slightly less intensely colored, but exhibits similar brightness and lightfastness.

EXAMPLE 3

Fabric samples comprising KYNOL$^{tm}$ fibers and Nomex fiber in ratios of 80/20, 70/30, 50/50, and 25/75 are subjected to union dyeing in accordance with the process of Example 1. Uniform colors are obtained using from five to 7.5 percent of the cationic dyes Genacryl blue 3G, Genacryl yellow GL, Genacryl red GL, and Astrazon blue GL.

EXAMPLE 4

Samples of KYNOL$^{tm}$ novoloid fiber, and blends of KYNOL$^{tm}$ novoloid fiber and Nomex aramid polyamide fiber are dyed in accordance with Example 1, and subjected to xenon arc light to test lightfastness. The results are set forth in Table I.

TABLE I

Hues and Lightfastness of KYNOL™ and KNYOL™Nomex Fibers Dyed with Cationic Dyes

| Desired Hue | Dye | % dye | Lightfastness (xenon-arc) 20 hours | 30 hours | Fade |
|---|---|---|---|---|---|
| YELLOW | Genacryl yellow GL | 5-7.5 | 3–4 | 3 | DB |
| YELLOW | Genacryl yellow 5GF | 5-7.5 | 3–4 | 3 | DB |
| BROWN | Genacryl (red GL/yellow GL/ blue 3G) (52/35/13) | 5-7.5 | 4 | 3 | DW |
| ORANGE | Genacryl orange G | 5-7.5 | 4 | 3 | DW |
| RED | Genacryl red GL | 5-7.5 | 4–5 | 4 | D |
| RED | Basacryl red GL | 5-7.5 | 4–5 | 4 | DW |
| OLIVE | Genacryl (red G./yellow GL/ blue 3G) 50/35/15) | 5-7.5 | 4 | 3 | W |
| FOREST GREEN | Genacryl (yellow GL/blue 3G) (50/50) | 5-7.5 | 4 | 3–4 | W |
| BLUE | Genacryl blue 3G | 5-7.5 | 3 | 2 | DW |

Key to Shade Change

| | |
|---|---|
| 5 - None | B - Browner |
| 4 - Slight | D - Duller |
| 3 - Noticeable | R - Redder |
| 2 - Considerable | W - Weaker |
| 1 - Much Changed | Y - Yellower |

Percentages as set forth herein are based upon the following: fiber blends upon total weight of fiber; dye and stabilizer concentration upon weight of fiber to be dyed; dye carrier, formic acid, and acetic acid upon volume of dye bath; electrolyte, and surface active agent upon weight of dye bath.

While the invention has been described herein with reference to certain preferred embodiments, it is to be understood that various changes and modifications may be made by those skilled in the art without departing from the concept of the invention, the scope of which is to be determined by reference to the following claims.

What is claimed is:

1. A composition for dyeing novoloid fibers, said composition comprising from about one to about ten percent cationic dye based upon fiber weight, from about three to about ten volume percent carrier medium, from about one to about ten volume percent formic acid, from about one to about five volume percent acetic acid, from about one to about four weight percent electrolyte, and water.

2. A composition as set forth in claim 1 wherein said cationic dye is present in a concentration of from five to about 7.5 percent.

3. A composition as set forth in claim 2 wherein said carrier medium is benzyl alcohol.

4. A composition as set forth in claim 2 wherein said carrier medium is benzyl alcohol/acetophenone.

5. A composition as set forth in claim 1 wherein said formic acid is present in a concentration of from about one to about five volume percent, and said acetic acid is present in a concentration of from about one to about 2 volume percent.

6. A composition as set forth in claim 1 wherein said composition further comprises less than 0.1 weight percent surface active agent.

7. A dye bath comprising: from five to 7.5 percent cationic dye, based on weight of fiber to be dyed; from about five to about six volume percent of a dye carrier selected from the group consisting of benzyl alcohol and benzyl alcohol/acetophenone; from about one to about five volume percent formic acid; from about one to about two volume percent acetic acid; from about 1.5 to about 3.0 weight percent electrolyte; and water.

8. A composition for dyeing novoloid fibers, said composition comprising, per liter, 1. from about ⅓ to about 3⅓ grams cationic dye;
2. from about 30 to about 100 ml carrier medium;
3. from about 10 to about 100 ml formic acid;
4. from about 10 to about 50 ml acetic acid;
5. from about one to about 4 weight percent electrolyte; and
6. water.

9. A composition as set forth in claim 8, wherein said cationic dye is present in a concentration of from 1⅔ to about 2.5 grams per liter.

10. A composition as set forth in claim 9, wherein said carrier medium is benzyl alcohol.

11. A composition as set forth in claim 9 wherein said carrier medium is benzyl alcohol/acetophenone.

12. A composition as set forth in claim 8, wherein said formic acid is present in a concentration of from about 1 to about 5 volume percent, and said acetic acid is present in a concentration of from about 1 to about 2 volume percent.

13. A composition as set forth in claim 8, wherein said composition further comprises less than 0.1 weight percent surface active agent.

14. A dye bath comprising, per liter, 1. from 1⅔ to 2.5 grams cationic dye;
2. from about 50 to about 60 ml of a dye carrier selected from the group consisting of benzyl alcohol and benzyl alcohol/acetophenone;
3. from about 10 to about 50 ml formic acid;
4. from about 10 to about 20 ml acetic acid;
5. from about 1.5 to about 3.0 weight percent electrolyte; and
6. water.

* * * * *